United States Patent [19]

Stock et al.

[11] 4,299,722

[45] Nov. 10, 1981

[54] INTRODUCTION OF FLUENT MATERIALS INTO CONTAINERS

[75] Inventors: Arthur J. Stock, Lakewood; Paul C. Williams, Medina, both of Ohio

[73] Assignee: Stock Equipment Company, Cleveland, Ohio

[21] Appl. No.: 82,716

[22] Filed: Oct. 9, 1979

Related U.S. Application Data

[63] Continuation of Ser. No. 898,959, Apr. 21, 1978, abandoned.

[51] Int. Cl.[3] ..... G21F 9/16

[52] U.S. Cl. ..... 252/628; 264/0.5; 264/71; 264/240; 264/333

[58] Field of Search ..... 252/301.1 W; 264/71, 264/240, 333, 0.5; 366/2, 179

[56] References Cited

U.S. PATENT DOCUMENTS

| | | | |
|---|---|---|---|
| 945,607 | 1/1910 | Rogers | 264/71 |
| 3,940,628 | 2/1976 | Stock et al. | 252/301.1 W |
| 4,056,362 | 11/1977 | Gablin | 252/301.1 W |
| 4,235,739 | 11/1980 | Baatz et al. | 252/301.1 W |

FOREIGN PATENT DOCUMENTS

| | | | |
|---|---|---|---|
| 2637858 | 3/1978 | Fed. Rep. of Germany | 252/301.1 W |

OTHER PUBLICATIONS

Stouky, R. J., "Operating Cost Nuances of Nuclear Power Plant Radioactive Waste Disposal, a Paper Presented at the Symp. on Management of Low-Level Radioactive Waste", Atlanta, Ga., May 1977 and Published in *Management of Low-Level Rad. Waste,* vol. 1, Pergamon Press, N.Y. (1979), pp. 473-512.

*Primary Examiner*—Deborah L. Kyle
*Attorney, Agent, or Firm*—Pearne, Gordon, Sessions, McCoy & Granger

[57] ABSTRACT

A process for introducing into a container dry particulate solidifying agent, such as portland cement, and a fluent material, such as a slurry or solution, that is mixable with the solidifying agent to provide ultimately a mass that is at least partially solidified within the container. The solidifying agent which when in a dry condition often has a sizable volume of air contained therein, and a predetermined quantity of the fluent material, are introduced into the container and, after the container is closed, agitated in the container to form a first mixture in which the air is removed from within the solidifying agent. The container is then opened and a second quantity of the fluent material is placed in the container with the first mixture to fill the container to a desired degree. The container is then closed and the first mixture and second quantity of fluent material are agitated to provide a second mixture which is then at least partially solidified in the container. The fluent material is disclosed as radioactive, and two fluent materials of different radioactive intensities may be introduced into the container to produce a solidified mass of a desired radioactive intensity.

9 Claims, 12 Drawing Figures

336
337
8
338
320
333
349
348
8
341
343
7
7
350
331
346
332
231
329
330
C
322
226
347
326
D
327
325
324
323
328
321
334
335

INTRODUCTION OF FLUENT MATERIALS INTO CONTAINERS

This is a continuation of application Ser. No. 898,959, filed Apr. 21, 1978, now abandoned.

REFERENCE TO RELATED APPLICATIONS

This application relates to and incorporates by reference the disclosures of U.S. Pat. Nos. 3,835,617, 3,932,979, 3,940,628, 3,966,175, 3,972,420, 3,994,626, and 4,030,708.

BACKGROUND OF THE INVENTION

The invention relates to the packaging of fluent material such as slurries, solutions, and the like and especially to situations wherein the fluent material is to be packaged in a container such as a metal drum, and preferably at least partially solidified in the container by use of one or more dry particulate solidifying agents. The invention provides particular advantages in the introduction into a container of dry solidifying agent and fluent material and the intermixing therof in such a way that the container can be essentially filled.

While the invention may be used for the packaging of various types of materials, it ca be exceptionally advantageously employed in the packaging and disposition of dangerous materials such as radioactive wastes produced in nuclear electric power generating stations.

In these stations, although water of greatest possible purity is used, minor amounts of impurities are unavoidably present in the water initially introduced into various conduits of the reactor apparatus. Further impurities occur because of action of the water on the metal of conduits through which it passes. These impurities may become radioactive, particularly in water that passes through the reactor. Traces of cobalt leached out of stainless steel piping are particularly troublesome, since cobalt develops an intense form of radioactivity having a long half life.

In nuclear power stations, it is a practice to subject the water to cleaning action by passing it through treating beds of suitable ion-exchange resins that, through chemical and filtering action, remove dissolved and suspended impurities from the water to maintain it at the desired high purity. Otherwise, the accumulation of impurities could result in scaling on the heat transfer surfaces, which would result in loss of efficiency or difficulty in operations. Resin particles of one type widely used for this purpose are those approximately 20 mesh in size; particles of another widely used type are much smaller, approximately 300 mesh.

The contaminated resins of either type are removed from the treating beds by sluicing them out with water. The resulting slurry or dispersion of resin particles in water is collected in a waste resin tank at the plant. The method disclosed hereafter is particularly advantageous for packaging of this type of radioactive slurry for disposition.

Another type of radioactive waste materials that may be handled by the present invention is known as "evaporator bottoms". These include concentrated liquid wastes from the plant, such as solutions containing boric acid, borax, sodium sulphate, and the like, that are used in the control of the reactor, or for washdown of equipment or plant for cleansing or decontamination, or wash water for employees, or water containing chemical laboratory liquid wastes. These solutions or dispersions containing radioactive impurities are temporarily stored; periodically portions are evaporated, leaving a concentrated solution or dispersion of reactive materials in water known as "evaporator bottoms".

Still another type of radioactive waste that may be handled according to the invention is powdered dry radioactive waste resulting from incineration or calcining of radioactive waste material.

After packaging, the radioactive waste material is usually shipped to a waste station place. Stringent laws, rules and regulations govern the disposition of radioactive materials and their transportation over highways, on railroads and by other modes of transportation. In general, the material must be shielded so that radiation emanating from the material does not exceed maximum levels established by law and regulations. Furthermore, it is desired that in case of an accident causing dumping of radioactive load material, there should be no fluidic materials that can penetrate the ground or mix with streams or ground water and cause radioactive contamination. It has, therefore, been proposed to provide a mixture of radioactive waste material such as resin particles containing radioactive material, a solidifying agent, such as cement, and water, in a container such as a steel drum and to allow the mixture to solidify in the drum before shipment.

Usually it is desired that the container be filled to as great an extent as possible with the solidified mixture, to reduce shipping and storage costs.

In some prior systems, radioactive resins, cement and water are mixed in mixing equipment outside of the shipping container. This involves exposure of considerable amounts of equipment, and possibilities of considerable exposure of personnel, to radioactivity.

Prior U.S. Pat. Nos. 3,835,617; 3,940,628 and 3,966,175 disclose methods and apparatus for packing fluent material or other dangerous material, by remote control and without human handling, by introducing a predetermined quantity of dry solidification agent and a predetermined quantity of radioactive or other dangerous fluent material into a container, closing the container, agitating the container to mix the contents thereof, and then allowing the material to solidify in the container.

A problem occasionally encountered with the procedure is that while the container such as a steel drum is initially loaded as full as possible with dry cement and fluent material, after mixing the container is only about 50 to 80 percent full. This is because a significant volume of air is contained in the dry cement between its particles. Since it presently costs between $25.00 and $500.00 or more per drum of 50 gallon size to purchase a drum, and package radioactive material in it and ship and store a drum, and since a typical nuclear power station unit develos from 1,000 to 4,000 drums of radioactive waste a year, the economic loss due to incomplete filling of the drums is substantial.

Another problem occasionally encountered with this procedure arises because the radiation intensity of the loaded drum can vary considerably depending on the source of the radioactive material in a drum, as for example, whether the radioactive material is primarily the resin particles in a slurry from a resin tank, or evaporator bottoms. Evaporator bottoms usually have a much lower radiation level per unit of volume than a slurry of radioactive resin particles from the resin tank. Generally, a drum containing evaporator bottoms as the only radioactive waste requires little if any shielding during shipment, has a lower transportation cost for this reason, and a lower storage cost since it need not be buried in a cask. On the other hand, drums containing as the only radioactive material resin particle slurries (which are normally a relatively small percentage of the total volume of radioactive waste developed in a nuclear power station) must usually be quite heavily shielded during shipment, and therefore have high transportation and storage costs.

The present invention resolves the difficulties indicated above and affords other features and advantages heretofore not obtainable.

SUMMARY OF THE INVENTION

It is a general object of the invention to overcome the above and other problems relating to the disposition of radioactive waste materials. Another object is to provide an improved method in which fluent material can be placed and mixed in containers along with one or more dry particulate solidifying agent or agents, such as portland cement. A further object is to reduce the number of containers required to package, transport and store to dispose of fluent material containing radioactive or other dangerous material that is mixed with a dry particulate solidifying agent in the containers. A further object is to introduce into a container two or more radioactive materials at different levels of radioactivity to produce in the container a mass having a desired level of radioactivity.

To accomplish these and other objects, the present invention provides a method for loading a container such as a steel drum with a quantity of one or more dry particulate solidifying agents and a fluent material such as dangerous or radioactive liquids or slurries containing radioactive or otherwise dangerous particulate materials that are mixable with the solidifying agent. The method ultimately provides a mass that is ultimately at least partially and preferably completely solidified within and substantially fills the container. The method includes the steps of introducing into the container a predetermined amount of the dry particulate solidifying agent that normally contains a substantial volume of air entrained between particles, and a quantity of the fluent material sufficient to at least partially and preferably completely fill the container, and then closing the container. The solidifying agent and the fluent material are then agitated in the container to cause the particles to mix with the fluent material and the liquid of the fluent material, thus removing the entrapped air from the solidifying agent and forming a first mixture of a volume considerably less than the initial volume of the contents of the container. The container is then opened and a second quantity of fluent material is introduced into the container that is sufficient substantially to fill the container and provide a predetermined proportion of total fluent material to solidifying agent, after which the container is closed. The first mixture and the second predetermined quantity of fluent material are then agitated in the container to provide another mixture which subsequently becomes at least partially, and preferably completely, solidified with no free liquid, in the container, and that fills the container to a considerably greater degree than if the second filling and agitating operation had not been carried out. More than two such operations of introducing fluent material can be carried out if desired.

In accordance with another aspect of the invention a first fluent material of a certain measured level of radioactivity and a second fluent material of another measured level of radioactivity different from that of the first fluent material are introduced into the container in amounts calculated to provide an advantageous intermediate level of radioactivity to achieve certain economies in transportation and storage of the container. Advantageously these fluent materials of different radioactivities are introduced in two steps, as described above.

BRIEF DESCRIPTION OF THE DRAWINGS

These and other objects, features and advantages of the invention will be apparent from the following description of embodiments of the invention in connection with the accompanying drawings, in which.

DISCLOSURE OF PREFERRED EMBODIMENT

General Arrangement

Figure 1:
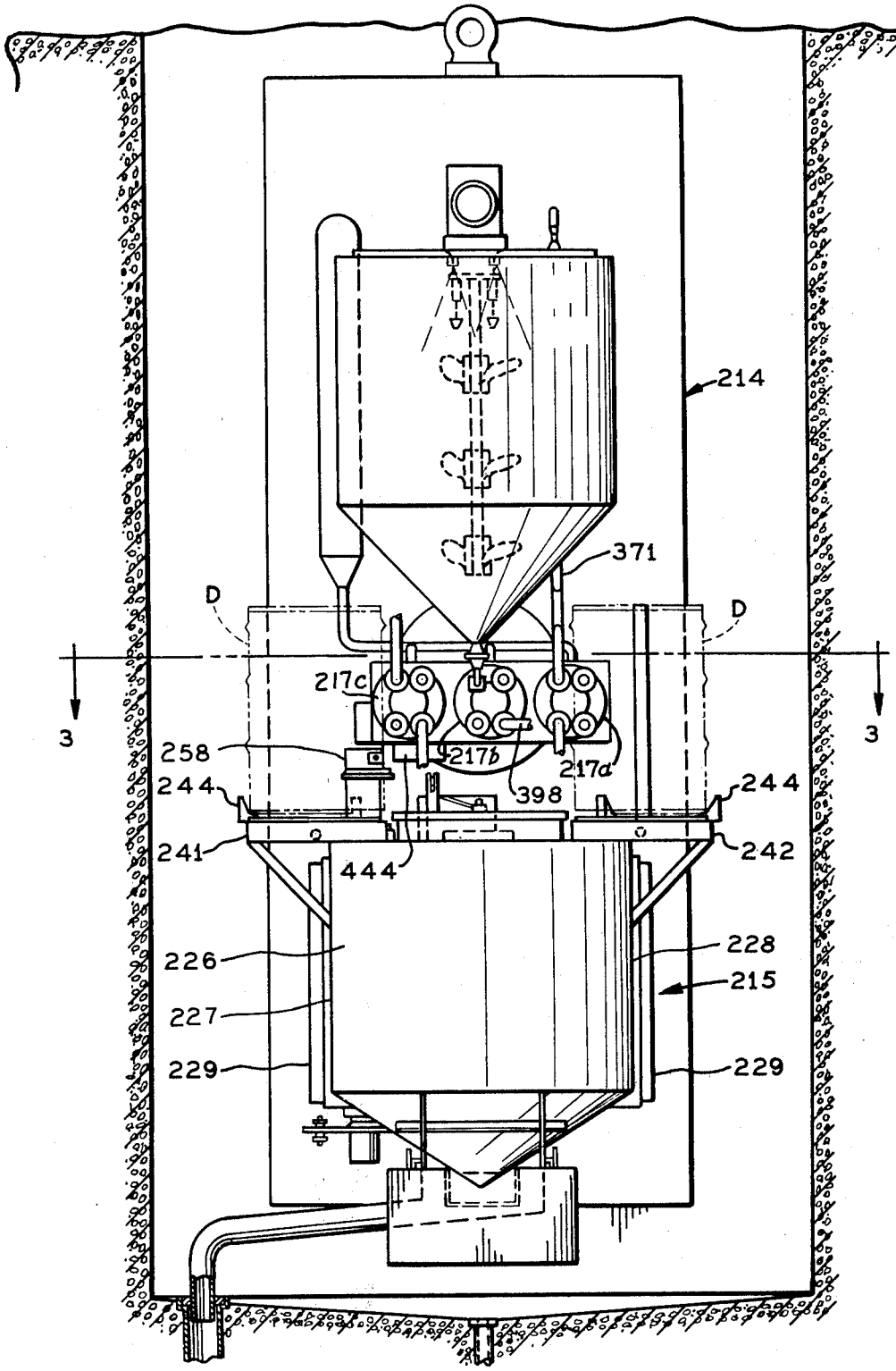
FIG. 1 is an elevational view of an apparatus for performing the method of the invention, parts, mostly piping, being omitted for the sake of clearness.

For illustrative purposes, the method of the invention will be described in connection with the disposition of radioactive waste material in the form of resin particles containing radioactive materials, like those described above, or in the form of evaporator bottoms or powdered dry wastes with added liquid. Preferably, the radioactive materials including liquid such as water, and one or more dry solidifying agents such as cement with or without additives, are placed into a container such as a steel drum, and mixed in the container in accordance with the process. The apparatus where most of these steps are carried out is referred to herein as the "drumming station". After this the container is moved into storage and the mixture is allowed to solidify and the radioactivity may be allowed to decay in storage.

While, for convenience, cement is disclosed below as the solidifying agent and water as the liquid, it is to be understood that more than one solidifying agent may be used, that other suitable solidifying agents, such as asmphalt or certain natural or synthetic resins, or mixtures with or without other additives, may be used, and that suitable liquids other than water may be used.

For convenience, the term "drum" is used hereafter to designate steel drums or barrels as such, as well as other types of containers suiteble for the indicated purposes.

Drumming Station

The apparatus in the drumming station illustrated in FIGS. 1–5 comprises three basic components: a metal shield wall 214, drumming equipment 215, and a set of pumps 217*a, b, c,* of which pumps 217*a, b* are metering pumps and pump 217*b* is a pump used for decanting purposes.

The shield wall 214 serves as a locating and anchoring means for components 216, 217*a, b, c.* It is formed of strong metal to support the other components and to serve as a barrier to stop the escape of harmful radiation from the side of the shield wall carrying these components, to the other side.

The shield wall is rigidly but demountably attached to the concrete building wall by an accurately machined, grouted-in frame 218 (FIGS. 2 and 3) surrounding wall opening 219. The shield wall is secured to the frame by bolts and nuts 220 on the safe side of the shield wall. The shield wall preferably overlaps the opening 219 to provide an offset joint that prevents radiation leakage around the edges of the shield wall.

The drumming equipment 215 illustrated comprises a closed housing 226 supported from the side of the shield wall 214 facing into the drumming station. This housing (FIGS. 1–4) has upstanding sides 227, 228 carrying detachably mounted access plates 229. The top 231 of the housing 226 has a hatch opening 232 closed by a hinged hatch cover 234 to prevent escape of radioactive material. The housing 226 and hatch cover 234 when closed provide a closed chamber in which drum loading and mixing occurs. The hatch cover 234 permits access to the enclosure for introduction or removal of drums, while preventing escape into the atmosphere of air displaced by materials loaded into the drum, and while preventing escape of radioactive material due to splashing should the drum being processed develop a leak or should material be accidentally spilled during the loading operation. Hatch cover 234 can be moved to closed and open positions by a lever 236 pivotally supported on housing 226.

A fixed loading dock 241 is externally mounted at one side of the housing 226 and is adapted to support a drum to be filled, shown in broken lines in FIG. 1. The drum is first deposited by an overhead crane on this dock. A fixed unloading dock 242 is externally mounted on the other side of housing 226; a drum removed from housing 226 is set by the crane on this unloading dock, also as shown in broken lines in FIG. 1, and the intensity of radiation emanating from the drum is measured by known radiation monitor means 243 that sends by known means 243*e* electrical signals to a control station where the information is noted. Each of the loading and unloading docks carries a scale 244 connected with known means for reporting the scale reading to the control station.

Inside of drumming equipment 215 is a drum positioner cradle mechanism 245 (FIG. 5A) adapted to carry a drum and move it (FIGS. 3 and 5A) about a vertical axis P from a drum loading and unloading position "I", then to a first intermediate position "II" in which the drum is clamped into its cradle in a vertical position, then to a second intermediate position "III" in which the drum is opened by unscrewing and removing its cap, then to a third intermediate position "IV", where the drum is first partially filled, then back to position III where the cap is replaced, and then to intermediate position "II" where the drum is turned end-over-end to agitate and mix its contents, whereupon air is removed from containment in the dry cement. Then, in accordance with the invention, the drum is returned to position "II" where its cap is again removed, then again to intermediate position "IV" where the drum is completely filled, then back to position "III" where the drum is again capped, then again to position "II" where the drum is again turned end-over-end to agitate and mix its contents. From position "II" the cradle returns the drum to location "I" under the hatch 234 where the drum can be removed from the drumming equipment.

The cradle mechanism 245 comprises a vertical shaft 246 (FIGS. 2 and 3) on which a cradle frame 247 is rigidly mounted; the shaft 246 is rotatably and vertically slidably mounted in bearings mounted at the top and bottom of housing 226. A cradle 251 is rotatably supported in the cradle frame 247 by bearings for rotation about a horizontal axis H. The cradle frame thus forms a trunnion in which the cradle can be rotated to impart to the drum the desired end-over-end motion to thoroughly mix the contents of the drum, tumbling movement of loose mixing weights in the drum aiding this mixing.

The cradle frame 247 is moved about axis P to angular positions I, II, III, IV, indicated above, by known actuating means and its supporting shaft 246 and cradle 251 carrying a drum can be raised and lowered as required to permit movement of the cradle and performance of necessary steps in the positions I–IV by a known type of screw jack mechanism. The screw jack mechanism is adapted to raise the cradle to an upper elevation, referred to hereafter as the "U" elevation in positions III and IV, and to lower the cradle to a lower elevation, hereinafter referred to as the "L" elevation, for movement between the positions and for operating in positions I and II.

When the cradle frame 247 is raised in either of positions III or IV, an upwardly projecting tapered dowel pin 261 (FIG. 2) fixed to the top of the cradle frame 247 engages in an opening of one of two hardened steel bushings 261*b* in the top wall 231 of the housing 226. This assures accurate and positive location of the cradle in positions III and IV for the filling and capping operations that are carried out in these positions.

When the cradle frame 247 is in any of positions I, III or IV, cradle 251 can be held in a vertical position in the cradle frame by a latch member 262 (FIG. 5A) pivotally mounted on the cradle frame and biased by compression spring 263 to latching position where the beveled end 264 of member 262 engages between a pair of spaced lugs 265 on the cradle. The latch member can be released from the cradle by the tapered end 266 of a pin 267 that extends through the shield wall and is adapted to be axially inserted into a flare-mouthed socket 268 on the cradle to a depth sufficient to contact and release the latch member. When pin 267 is so inserted, it secures frame 247 against angular or other movement while the cradle is being rotated about its horizontal axis H to agitate the contents of the drum. After cradle rotation has ceased and the cradle has been properly located with the drum vertical and its cap side up by suitable known means, such as conventional electrical interlocking means, pin 267 is withdrawn from socket 268, and latch member 262 re-engages the cradle to lock it in the vertical position with respect to its frame 247. Pin 267 is moved axially as required by a double-acting fluid energized cylinder 269 having control valves that are actuated in a known manner from the control station. Cylinder 269 is equipped with suitable conventional controls to prevent starting of the below described means for rotating the cradle while the latch member 262 engages the cradle.

Figures 5A, 5B:
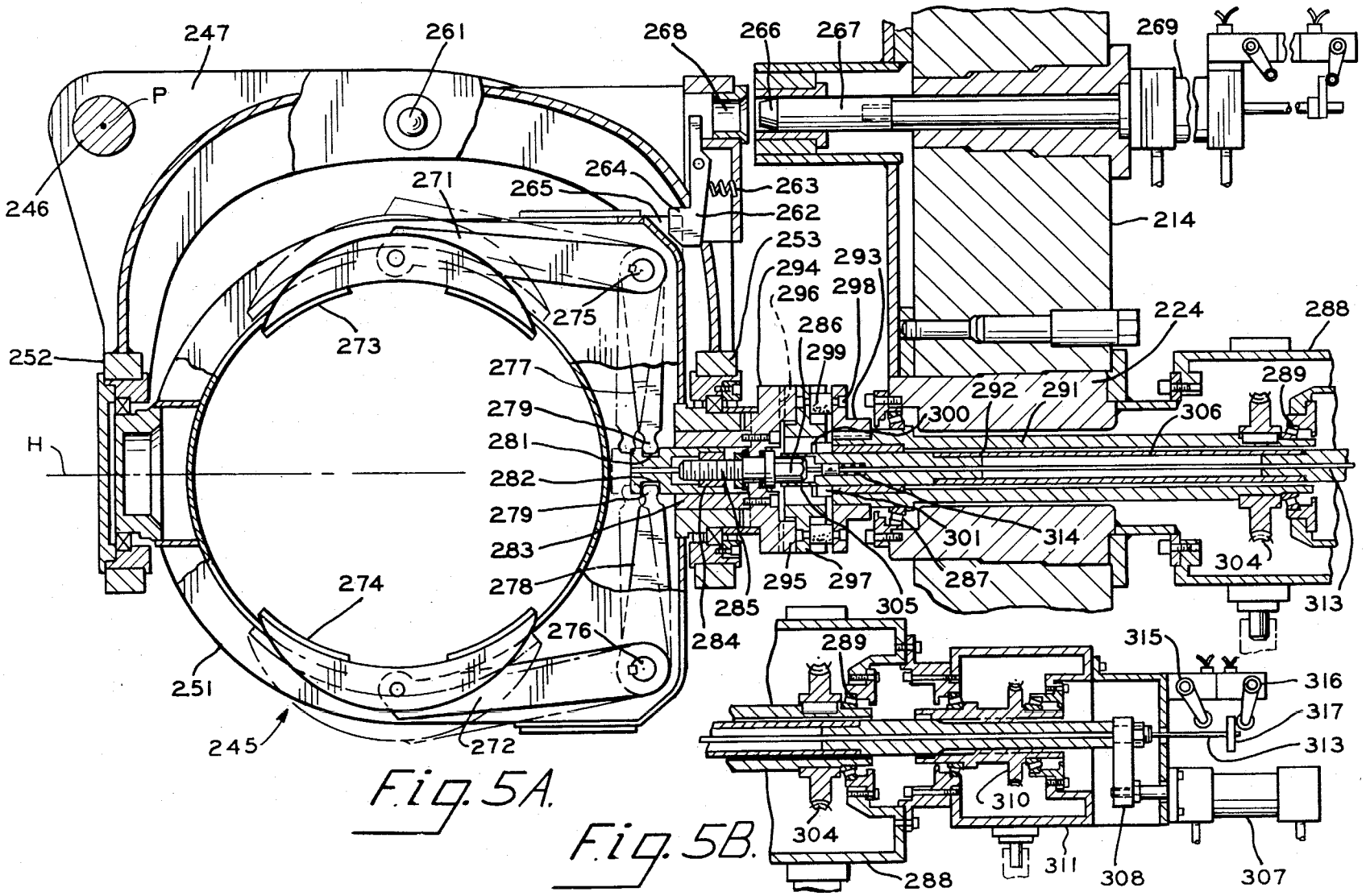
FIGS. 5A and 5B show to an enlarged scale and in plan a cradle frame and cradle, as well as associated apparatus for holding the drum in the drumming apparatus.

The drum may be centered and firmly clamped in its cradle 251 by clamping means as shown in FIGS. 5A and 5B. Two opposing clamping arms 271 and 272 pivotally carry clamping members 273, 274 and are rigidly mounted on shafts 275, 276 pivotally mounted in the cradle on axes parallel to the drum axis. These shafts rigidly carry arms 277, 278 having rounded outer ends 279 that ride in an external groove 281 of a member 282 that is axially slidably mounted in hub portion 283 of the cradle in hub portion 253 of the cradle frame 247 nearest the shield wall when the cradle frame is in position II-L. When member 282 is moved axially away from the drum carried by the cradle, the clamping arms 271, 272 move toward the drum and their clamping members firmly engage the drum. When the member 282 is moved toward the drum, the clamping members release the drum.

Member 282 is so moved by engagement of an internally threaded nut 284 rigidly mounted in member 282 with an externally threaded screw 285 rotatably, but axially immovably mounted on hub portion 283 of cradle 251. Screw 285 has a projecting end 286 that has hexagonal cross section. When, as will be described later, this hexagonal end portion is engaged and rotated relative to the cradle, member 282 will move axially and, depending on its direction of rotation, will clamp or unclamp the drum.

The clamping means of the cradle is actuated, and the cradle itself may be rotated, provided that latch member 262 is released, by the means shown in FIGS. 5A and 5B which comprises a stepped plug 224 that fits through the shield wall and carries at the drumming station side an internal bearing 287 and at its other side a removable gear box 288 carrying another bearing 289. These bearings carry an elongated member 291 for rotation about an axis that is coaxial with the axis H of the cradle when the cradle is in drum rotating position II. Member 291 has an axial opening 292. On the drumming station side, member 291 carries a driving coupling portion 293 adapted to engage and drive a driven coupling portion 294 on hub portion 283 of the cradle when the cradle is in position II.

Driven coupling portion 294 has axial and radial dogs 295 adapted to fit loosely in corresponding slots 296 of an intermediate coupling member 297 that is flexibly mounted, as by bolts 298, threaded onto rubber mounts 299 on driving coupling portion 293. Intermediate member 297 on its side away from portion 293 has slots 300 alternating with and spaced 90° angularly from its slots 296. Driving coupling portion 293 has radial and axial dogs 301 that can loosely fit in slots 300. The driving coupling member 297 is thus flexibly mounted so it is capable of substantial but limited lateral movement, so that the driven coupling member can engage and so that the cradle can be rotated even if there is substantial misalignment of the two coupling portions 293 and 294. By suitable means of known type, the dogs 295 of driven cradle coupling portion 294 and the slots 296 of intermediate member 297 flexibly mounted on driving portion 293 will always be positioned to extend horizontally when the cradle is not rotating, so that these dogs and slots can mate and engage when the cradle is swung into position II-L and can readily disengage when the cradle is moved out of such position. The power means for rotating the cradle when it is in position II-L is an electric motor controlled by known means from control station 14, that is adapted to rotate member 291 through suitable gears 304 in gear box 288.

The hexagonal portion 286 for actuating the clamping arms can be engaged by a socket 305 mounted on a shaft 306 that is rotatable and axially movable in member 291. Shaft 306 is moved axially as required by a double-acting fluid operated cylinder 307 connected through bracket 308 to the end of the shaft on the safe side of the shield wall and controlled by conventional means from station 14. After its socket is engaged with hexagonal end portion 286, the shaft is rotated as required to clamp or unclamp the drum, by an electric motor that rotates the shaft through suitable gears 310 in gearbox 311; the motor is controlled from the control station by suitable known means. Means for insuring that the cradle cannot be rotated until the drum is clamped in the cradle comprises a feeler rod 313 slidably coaxially mounted in shaft 306 and biased towards hexagonal portion 286 by spring 314 and limit switches 315, 316, adapted to be actuated by a stop 317 on the other end of the rod as it moves. When the rod is retracted sufficiently because of clamping travel of screw 285, the limit switches through suitable conventional interlocking circuit means permit rotation of the cradle; otherwise they do not.

Figure 6:
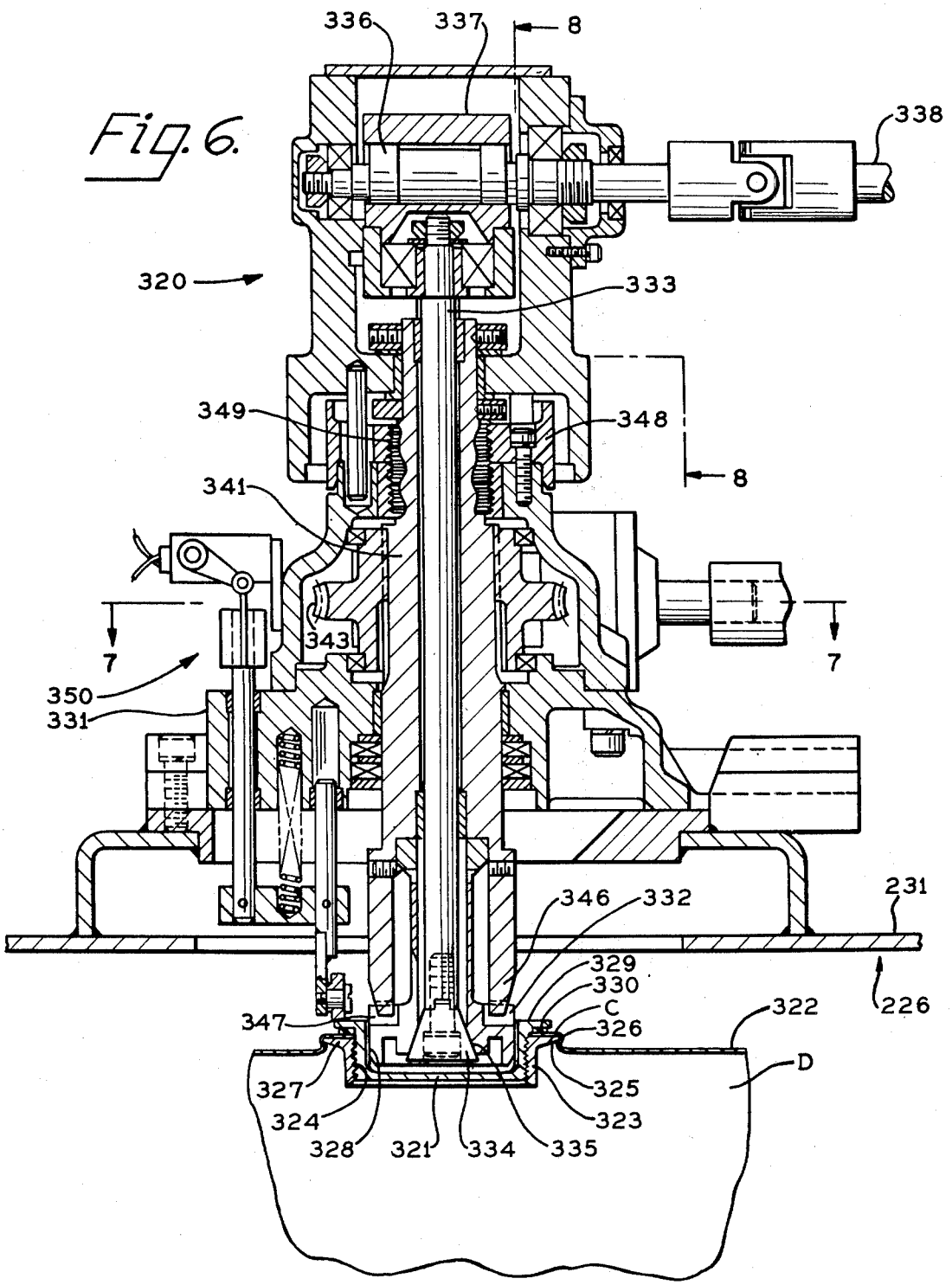
FIG. 6 is a section through the means for unscrewing a cap of a drum, holding it until it is desired to insert it again, and for reinserting and tightly screwing in the cap of a drum.

The drumming station also includes cap handling means 320 for removing and replacing a screw cap 321 in the top of a drum (FIG. 6). After the drum is at position III for cap removal, the cradle frame 247 is raised to elevation U to raise the drum D carried by the cradle 251 so its cap 321 can be engaged by means 320.

Figure 2:
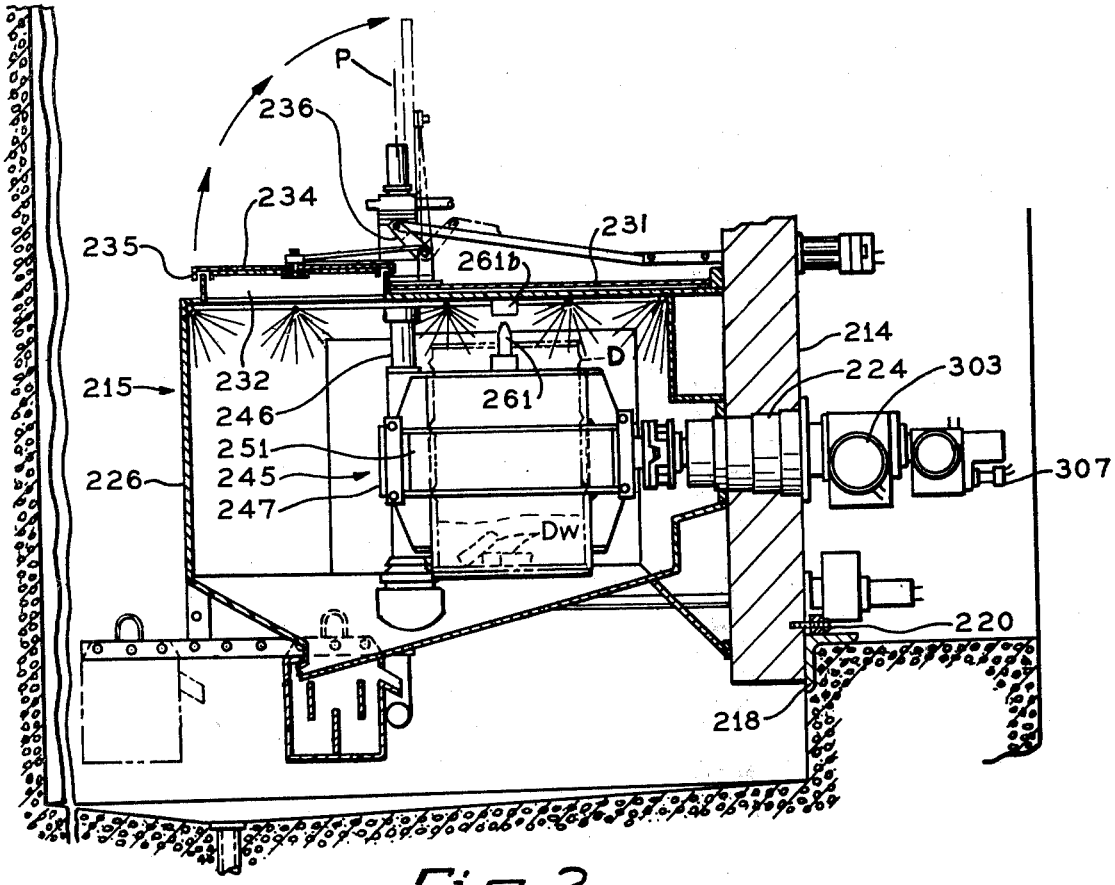
FIG. 2 is an elevation, partly in section, of a portion of the apparatus of FIG. 1.
Figure 3:
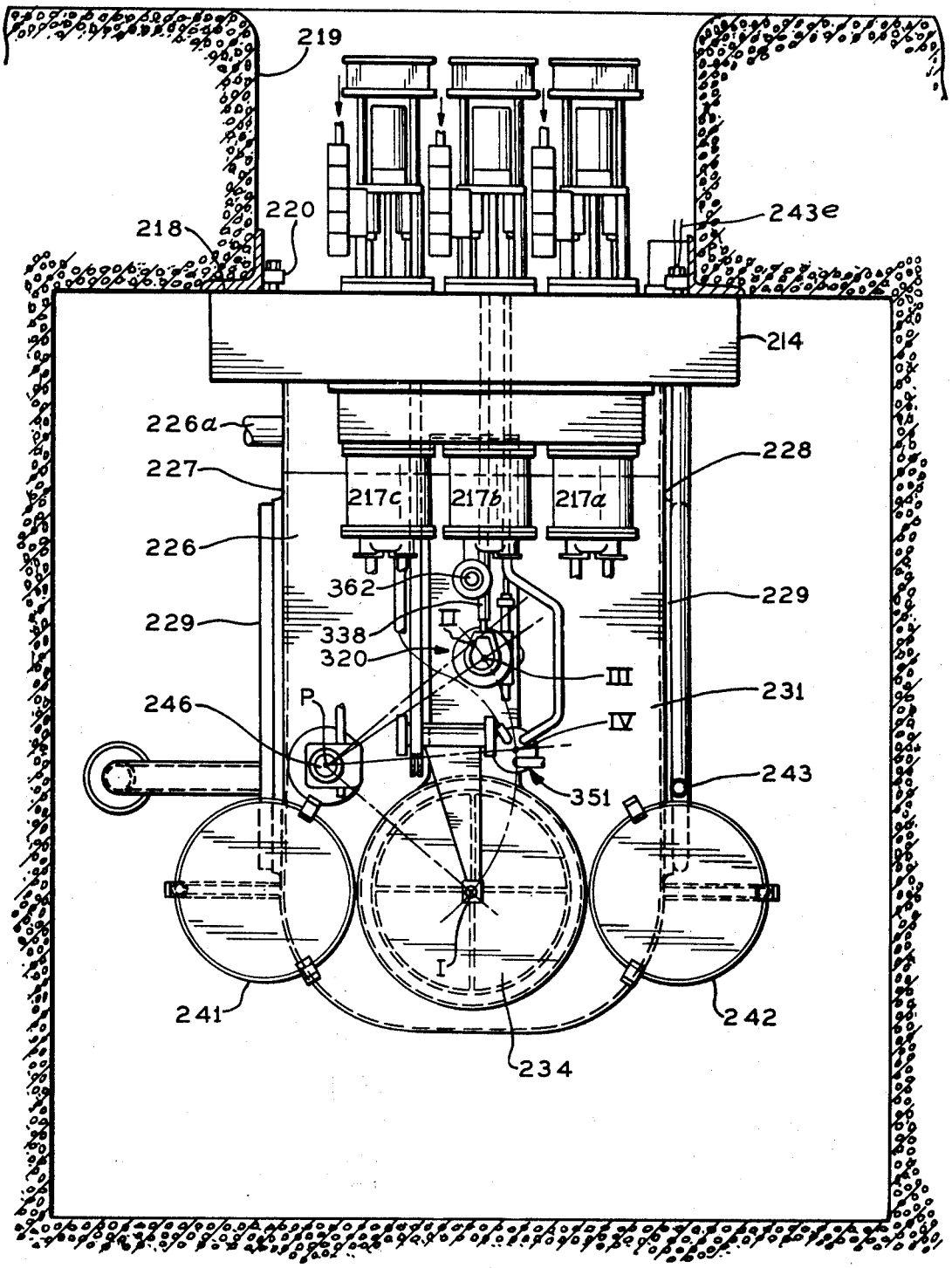
FIG. 3 is a plan view taken along line 3—3 of FIG. 1, to a somewhat enlarged scale.
Figure 4:
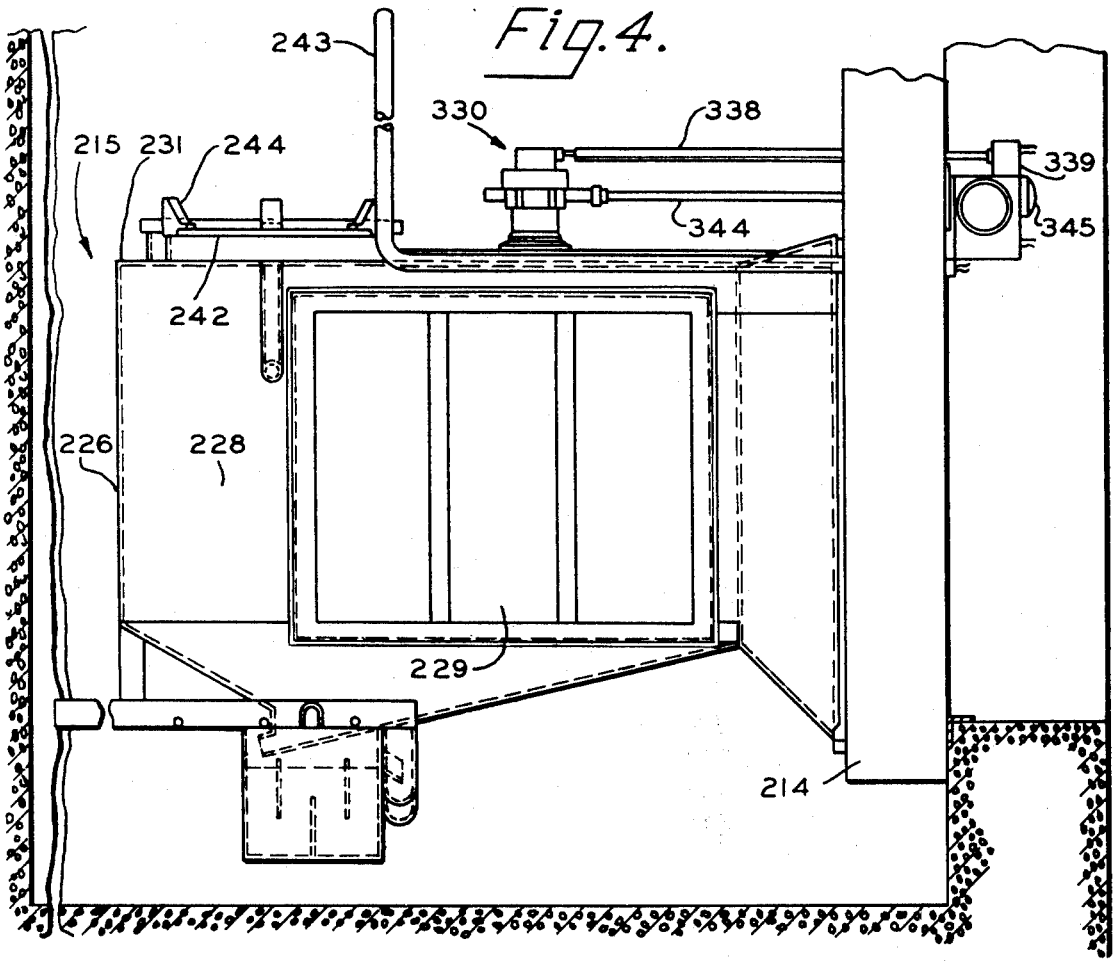
FIG. 4 is a side elevation of the lower portion of the drumming apparatus, in general corresponding to FIG. 3.
Figure 8:
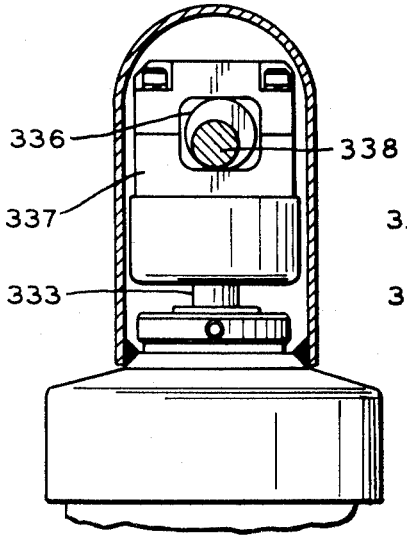
FIG. 8 is a section along line 8—8 of FIG. 6.
Figure 7:
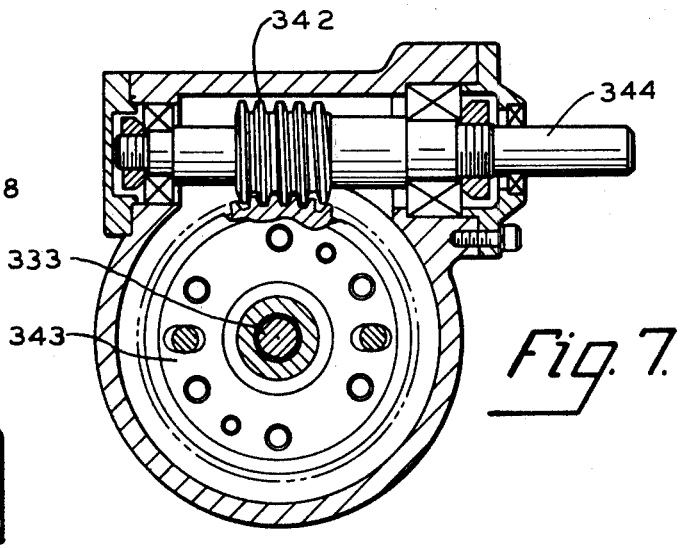
FIG. 7 is a section along line 7—7 of FIG. 6.

When brought into the drumming station according to the preferred form of the method of the invention, each drum will contain a preloaded accurately determined amount of cement or other solidifying agent Da with a volume of air contained therein and one or more freely movable mixing weights Dw, which may take the form of oblong pieces of steel about $1\frac{1}{2}'' \times 1\frac{1}{2}'' \times 6''$ in dimension (FIG. 2). A cap 321 closes the drum.

The drum, which is of generally cylindrical form, has a cap-supporting structure (FIG. 4) at the center of the top wall 322 of the drum comprising a steel collar 323 having an internal threaded opening 324 fixed in the top wall 322 of the drum (FIG. 6). Collar 323 has a radial flange 325 around the outer edge of which the top wall metal of the drum is crimped at 326 to hold the collar securely in the drum. Preferably a sealing ring 327 is clamped between the drum metal and the flange 325 to provide a fluid-tight seal between the collar and the drum. The internally threaded opening 324 is adapted to be closed by cap 321 that has an external thread that permits the cap to be screwed into the threaded opening. The cap has a central depression 328 of circular cross section with a suitable gripping surface, and an outward radial flange 329. Cap 321 also carries a sealing ring 330 that forms a fluid-tight seal between the cap and the drum.

Cap handling means 320 comprises frame structure 331 rigidly mounted on housing 226, and a wrench 332 rotatably and axially movably supported on the structure 331 to grasp and remove and replace cap 321. The wrench is a resilient expandable slotted collet that is resilient biased to contract and has an outer surface shaped to fit inside depression 328 of the cap, so that when the collet is expanded it firmly grasps the inner wall gearbox and electric motor unit 345 controlled from the control station by means 345*e*.

Shaft 341 is slidably, but non-rotatably, connected to worm gear 342 and has projecting dogs 346 at its lower end that engage shoulders 347 on the wrench 332 to rotate it when shaft 341 is rotated. Vertical travel of the wrench shaft and wrench are correlated with axial movement of the cap as it screws in or out by a nut 348 rigidly carried by frame 331 engaging a lead screw 349 fixed to shaft 341, the nut and lead screw having threads of the same linear pitch as the thread on the drum and cap, so as to retain exact relationship between threads in the drum and on the cap to facilitate recapping without crossthreading. The cap handling means is so designed that cam 336 maintains and holds tension on the pull rod that causes the wrench to grasp and firmly hold the cap during the removal of the cap and in the interim period while the drum is being filled. Sensing means 350 embodying spring loaded feeler 350*a* and limit switch 350*b* senses when the drum is in the proper position to have the cap removed or inserted, and through interlock means permits the apparatus 320 to operate; otherwise it prevents operation.

Figure 9:
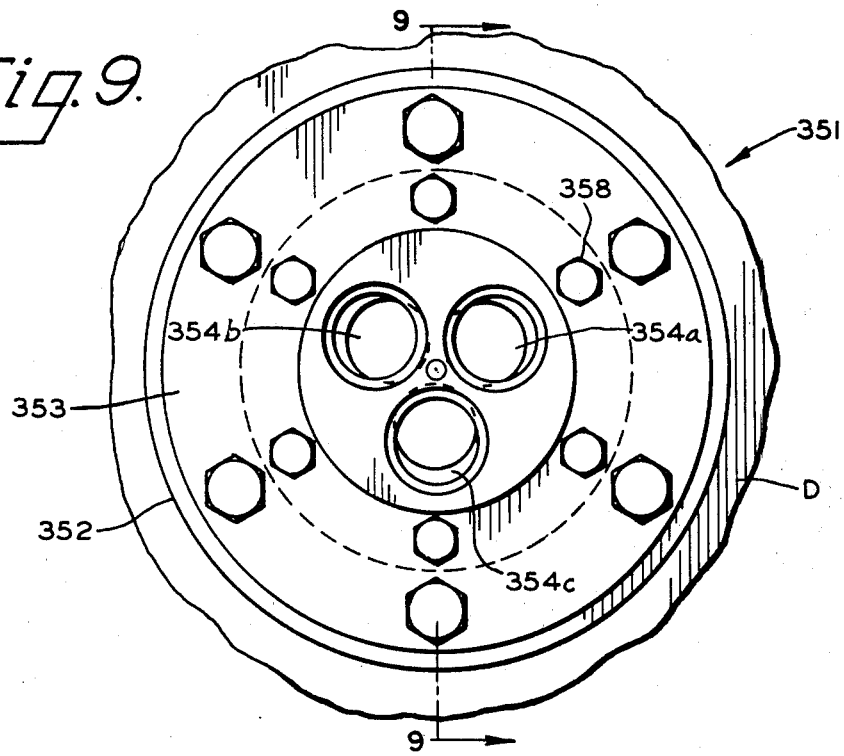
FIG. 9 is an enlarged plan view of the filler nozzle for filling a drum while it is in the drumming apparatus.
Figure 10:
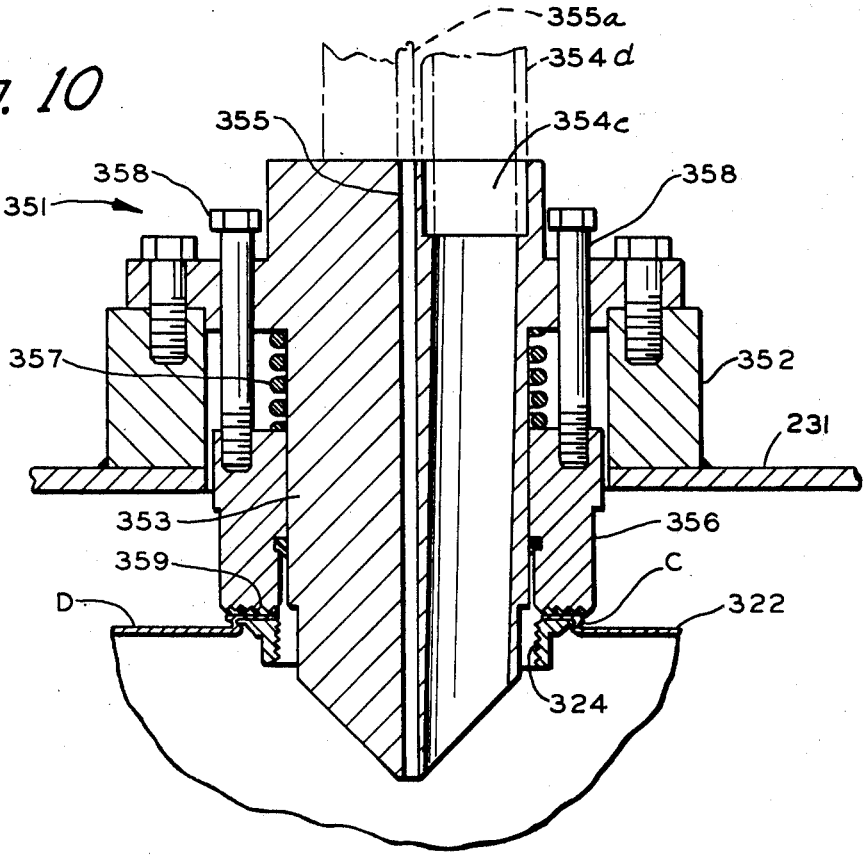
FIG. 10 is a section along line 10—10 of FIG. 9.
Figure 11:
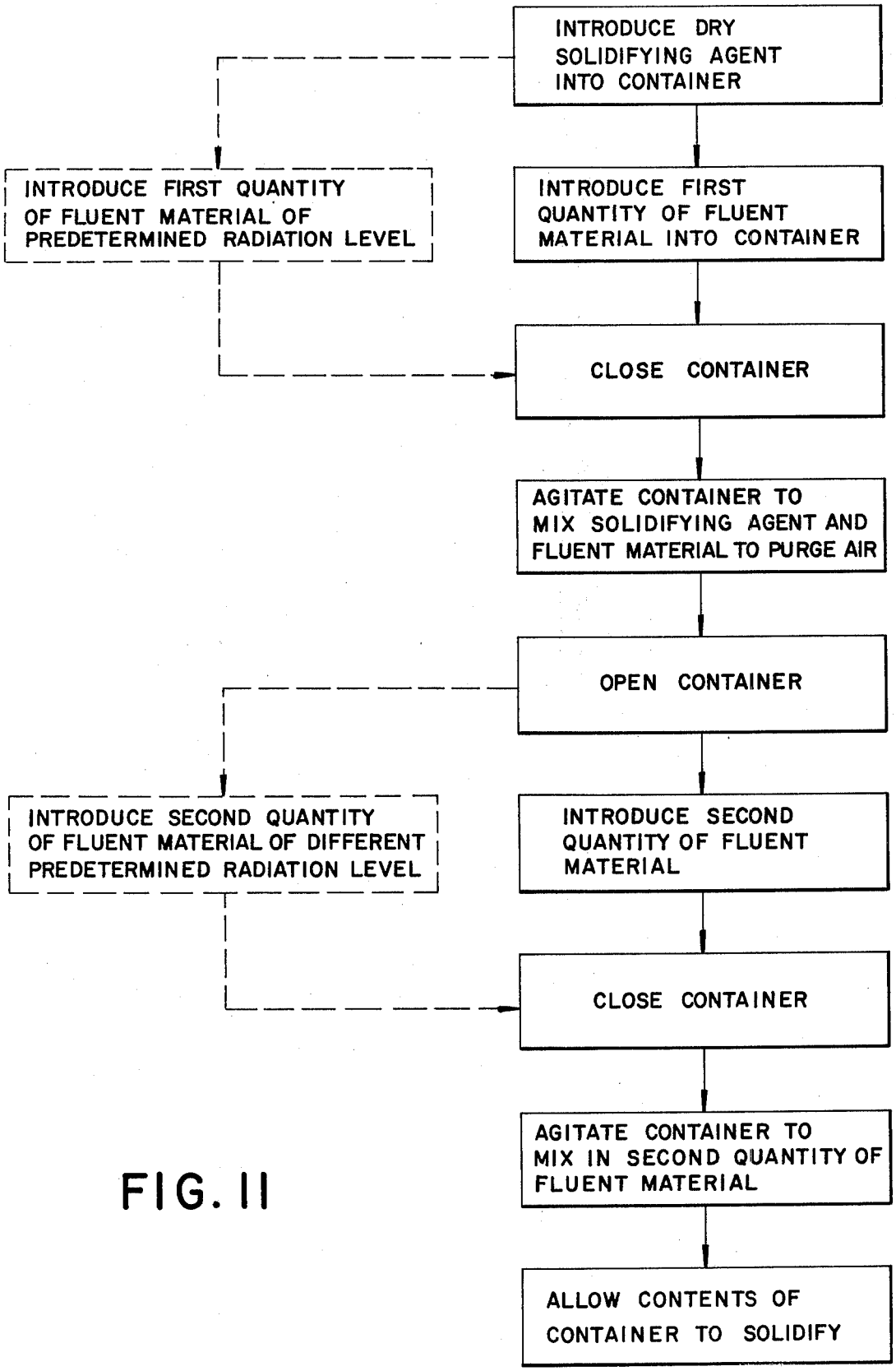
FIG. 11 is a process flow diagram illustrating a process of the invention.

After the cap has been removed at position III, the drum is ready to have the radioactive material put into it. This is accomplished by locating the drum carrying cradle 251 in the filling position IV and lifting the cradle and drum to engage the opening 324 with the fill nozzle 351 (FIGS. 9, 10) in the top wall 231 of housing 226. Nozzle 351 comprises boss 352 fixed to the top wall 231 and rigidly detachably carrying a nozzle portion 353 having a tapered lower end adapted to project through opening 324 into the drum D, and carrying several downwardly through openings 354*a, b, c;* 354*a* being for introduction into the drum of radioactive resin dispersion from the decanting tank, 354*b* for evaporator bottoms, and 354*c* being for venting during filling, being connected by conduit 354*d* to a closed venting system, not shown. The nozzle portion also has a smaller opening 355 that may be connected to means 355*a* for sensing the level of liquid in the drum, such as known means for sensing back pressure when the drum has been filled to the level of the bottom opening of vent 355.

Nozzle portion 353 slidably carries a collar 356 that is biased downwardly by compression spring 357 and downwardly limited by stop bolts 358. Collar 356 engages the drum top and seals with collar sealing ring 359 around the drum opening 324 to insure venting through the proper passage and prevents splashing or leakage during the filling operation.

While a pump of any of various types may be employed to pump the dispersion of radioactive particles in water through filler nozzle 351 into the drum D, the pump described in U.S. Pat. No. 3,994,626 is exceptionally advantageous. It delivers accurately measured quantities of liquid, and thus makes possible accurate remote control of the amount of liquid passed into the drum.

In the illustrative process, the solidifying agent, cement, for example, and mixing weights are placed in the drums before they enter the system, and the drums are immediately sealed. Each drum remains sealed until the drum is opened in the drumming station immediately prior to introduction of radioactive material, after which the drum is immediately closed. This prevents entrance into the drum of undesired moisture or other contaminants that could harmfully affect the solidifying agent or other material in the drum.

Operation of Drumming Station

A typical cycle of operation of the drumming station in accordance with the method of the invention is as follows, assuming that the cradle frame 247 is positioned so its cradle 251 is properly located in position I under the hatch cover 234, the cradle being positioned in the cradle frame to receive a drum in the vertical position; the hatch cover 234 is open; and a capped drum D containing dry particulate cement with air contained therein and mixing weights is on the loading dock 241 of the drumming station as shown in broken lines in FIG. 1. The operator in the control station then controls an overhead crane and its drum grab to pick up the drum from the loading dock and load it into the cradle. The operator then causes the hatch cover to close and the cradle frame 247 to move to position II. The clamping members are then actuated to clamp the drum. The cradle frame is then angularly moved to locate the drum at position III for cap removal. The cradle frame is then raised to cause its pin 261 to enter the socket for position III, and to raise the drum so its cap 231 can be engaged by the wrench 332 of cap handling means 320, which is then caused to operate to remove the drum cap. The cradle frame 247 is then lowered, and moved angularly to the drum filling position IV.

The cradle frame is here raised to cause its pin 261 to enter the socket for position III, and to raise the drum so the fill nozzle 351 extends into the drum. The filling cycle is then carried out as described previously by supplying a metered amount of a dispersion of radioactive particles in water.

After the proper predetermined amount of the dispersion of radioactive particles in the proper proportion of water has been put into the drum, the cradle frame is then lowered and moved angularly to the capping position III where the cradle frame will again raise the drum so it is in capping relation to the cap handling means 320, the wrench of which is still holding the cap in a position so that when rotated the cap moves downwardly and engages the threads in the drum. The cap is then reinserted and screwed tight as described above. The wrench of the cap handling means is then released and the cradle frame lowered.

The cradle frame is next moved to position II to locate the closed drum for mixing. The drive motor 303 for rotating the cradle is then started and the drum is rotated end-over-end about axis H to mix the drum contents thoroughly, the freely movable mixing weights Dw in the drum aiding thorough mixing. The mixing causes air to be removed from containment in the cement so that after mixing the drum is filled to a lower level than it was initially. When the mixing cycle has been completed, the mixer stops with the drum in an upright vertical position as described. Thereafter, the cradle frame is released from the housing so that it may be angularly moved to position III again for cap removal. The cradle frame is then raised to cause its pin 261 to enter the socket for position III, and to raise the drum so its cap 231 can be engaged by the wrench 332 of cap handling means 320, which is then caused to operate to remove the drum cap. The cradle frame 247 is then lowered and moved angularly to the drum filling position IV.

As before the cradle frame is raised so the fill nozzle 351 again extends into the drum. The second filling cycle is then carried out as described previously by supplying another metered amount of a dispersion of radioactive particles in water in addition to the mixture already in the drum to fill the drum to a desired level. If desired the second metered amount of a dispersion of radioactive particles in water may have a different level of radioactivity than that of the first amount. This technique is desirable in order to achieve a resulting level of radioactivity in the contents of the drum that falls within an intermediate advantageous range in order to achieve certain economies in transportation and storage. More specifically this the cap handling means is then released and the cradle frame lowered.

The cradle frame is next moved to position II to locate the closed drum for mixing. The drive motor 303 for rotating the cradle is then started and the drum is rotated end-over-end about axis H to mix the drum contents thoroughly, the freely movable mixing weights Dw in the drum aiding thorough mixing. The mixing causes air to be removed from between particles of the cement so that after mixing the drum is filled to a lower level than it was initially, because of the shrinkage in the volume of the mass of the solid and liquid contents of the drum due to removal of the air from between particles of the solid material. When the mixing cycle has been completed, the mixer stops with the drum in an upright vertical position as described. Thereafter, the cradle frame is released from the housing so that it may be angularly moved to position III again for cap removal. The cradle frame is then raised to cause its pin 261 to enter the socket for position III, and tc raise the drum so its cap 231 can be engaged by the wrench 332 of cap handling means 320, which is then caused to operate to remove the drum cap. The cradle frame 247 is then lowered and moved angularly to the drum filling position IV.

As before the cradle frame is raised so the fill nozzle 351 again extends into the drum. The second filling cycle is then carried out as described previously by supplying another metered amount of a dispersion of radioactive particles in water in addition to the mixture already in the drum to fill the drum to a desired level.

If desired, the second metered amount of a dispersion of radioactive particles in water may have a different level of radioactivity than that of the first amount. This technique is desirable in order to achieve in the contents of the drum a level of radioactivity that lies in an intermediate range advantageous to achieve desired economies in shielding, transportation, and storage while enabling disposition of radioactive waste material of high radioactive intensity by admixing it with usually more available waste material of lesser radioactive intensity. For example, in the illustrated embodiment, this technique may be used to dilute relatively small proportional amounts of the slurry of radioactive resin particles which have a relatively high level of radioactivity, with considerably larger portions of the evaporator bottoms in order to achieve a lowering of, and more uniformity in, radiation levels of the drums and to avoid having drums that contain large amounts of the slurry and have undesirably high levels of radiation.

After the additional predetermined amount of the dispersion of radioactive particles in the proper proportion of water has been put into the drum with the mixture already in the drum, the cradle frame is lowered and moved angularly to the capping position III where the cradle frame will again raise the drum so it is in capping relation to the cap handling means 320, the wrench of which is still holding the cap in a position so that when rotated, the cap moves downwardly and engages the threads in the drum. The cap is then reinserted and screwed tight as described above. The wrench of the cap handling means is then released and the cradle frame lowered.

The cradle frame is next moved to position II to locate the closed drum for additional mixing. The drive motor 303 for rotating the cradle is then started and the drum is again rotated end-over-end about axis H to mix the drum contents thoroughly. When the mixing cycle has been completed, the mixer stops with the drum in an upright vertical position as described. Thereafter, the cradle frame is released from the housing so that it may be angularly moved to position I for unloading.

Hatch cover 234 is then opened and the drum grab lowered through the hatch into the housing 226 to pick up the drum. The drum is then placed on the unloading dock 242 where its weight is checked by scale 244 and ita radiation level is monitored by monitor 243 and the information transmitted electrically to the control station for recording.

The operator places another drum with its predetermined quantity of dry cement on the loading dock 241, as shown in FIG. 1, while the drum being filled is in housing 226 in its filling cycle. The scale 244 on the loading dock is used to verify the cement quantity in the drum, and the drumming apparatus is ready for the next cycle.

After the operator loads the next drum into the cradle and starts the drumming cycle, he then places the processed drum in a decay vault for storage and brings another drum into position on the loading dock. Modifications may be made in this illustrative process of operations.

It is apparent that various modifications may be made in the illustrated system, apparatuses and processes, and also that some or all portions of the illustrated apparatus may be used for purposes other than those indicated.

The term "fluent material" is intended to cover slurries or dispersions of particulate materials in liquids, liquids such as solvents not containing particulate materials, other flowable materials that may be handled according to the apparatus and process of the invention; and one or more of such fluent materials The particulate materials may be of sizes different from those indicated above, as larger.

The term "solidifying agent" is intended to include one solidifying agent, or more than one solidifying agent, and additives if any are used.

While radioactive fluent materials of different intensities have been disclosed above as introduced at two different times, they may be introduced into the container at one time, either in separate streams or as a mixture; and one radioactive material, or two or more radioactive materials of different intensities of radioactivity, may be introduced into the container at one time or separately, with or without separate mixing in the container.

While the container has been disclosed as a steel drum, it is apparent that other types of containers may be used.

Furthermore, although the invention has been discussed above in connection with the radioactive wastes resulting from boiling water or pressure water plants, the process and apparatus of the invention may be employed in connection with the disposition of other types of radioactive wastes, and the invention may be employed in connection with the handling of other types of dangerous wastes or chemicals from other types of plants.

Furthermore, while there has been disclosed a cycle comprising two separate introductions of fluent material into a container, each followed by separate mixing, it is apparent that the cycle may include more than two separate introductions of fluent material involving at least two mixing operations or a separate mixing operation after each introduction of material.

These and other modifications may be made in the apparatus or process disclosed, and other modifications, advantages and modes of operation will become apparent without departing from the spirit of the invention.

What is claimed is:

1. A process of loading a container with a quantity of a dry particulate solidifying agent and liquid-containing fluent material that is capable of being mixed with solidifying agent and ultimately provide a mass of a mixture that is substantially completely solidified within and substantially fills said container, comprising: placing in said container a predetermined amount of dry solidifying agent having a substantial volume of air contained in the solidifying agent between the particles thereof; introducing into said container without mixing in said container a predetermined first amount of a liquid-containing fluent material to partially fill said container; closing said container; agitating said closed container to mix said solidifying agent and said predetermined first amount of fluent material in said container to provide a first mixture from which said volume of air is substantially removed from between the particles of said solidifying agent and is eliminated from the mixture of solidifying agent and fluent material; opening said container; introducing into said container a predetermined additional amount of at least one liquid-containing fluent material sufficient to substantially fill said container to a desired degree; closing said container; agitating said closed container to mix said first mixture and said additional amount of fluent material in said container to provide a resultant mixture; and completely solidifying said resultant mixture of material in said container to provide said solidified mass; said amount of solidifying agent, said first amount of fluent material and said additional amount of fluent material, and the total amount of liquid in said amounts of fluent materials being predetermined to cause essentially complete solidification of said resultant mixture in said container.

2. The process of claim 1 wherein said resultant mixture is essentially completely solidified in said container with essentially no free liquid remaining in the container.

3. A process for loading a container with a quantity of a dry particulate solidifying agent and radioactive fluent material that is capable of being mixed with said solidifying agent and ultimately provide a mass of a mixture that is solidified within and substantially fills said container and has a desired level of radioactivity not exceeding a predetermined level comprising: introducing into said container without mixing in said container a predetermined amount of dry particulate solidifying agent having a substantial volume of air contained in said solidifying agent between the particles thereof and an amount of a first fluent material sufficient to partially fill said container, said first fluent material having a predetermined first substantial level of radioactivity; closing said container; agitating said container to mix said solidifying agent and said fluent material in said container to provide a first mixture from which said volume of air is removed from between the particles of said solidifying agent and is substantially eliminated from said first mixture; opening said container; introducing into said container without mixing in said container at least one additional amount of a second fluent material that is added to said first mixture, said second fluent material having a predetermined second substantial level of radioactivity different from that of said first fluent material, said additional amount of said second fluent material being added in an amount sufficient to fill said container to a desired degree and to provide a predetermined proportion of total fluent material to said solidifying agent, and to provide a resultant mixture having a desired level of radioactivity that is substantially uniform throughout said resultant mixture and is between said first and second levels of radioactivity; closing said container; agitating said first mixture and said additional amount of fluent material in said container to provide a resultant mixture; and solidifying said resultant mixture of materials in said container to provide said solidified mass having said desired level of radioactivity.

4. The process of claim 3 in which said amount of said dry particulate solidifying agent and said amounts of said fluent materials are predetermined to cause essentially complete solidification of said resultant mixture in said container with no free liquid remaining in the container.

5. The process of claim 3 in which at least one of said fluent materials contains water that interacts with said solidifying agent during solidification, and the amounts of said solidifying agent, said fluent materials and said water introduced into said container are predetermined to cause essentially complete solidification of said final mixture in said container.

6. The process of claim 3 in which at least one of said fluent materials contains water that interacts with said solidifying agent during solidification, and the amounts of said solidifying agent, said fluent materials, and said water introduced into said container are predetermined to cause essentially complete solidification of said final mixture in said container with no free liquid remaining in the container.

7. A process according to either of claims 1 or 3, wherein said container containing said solidifying agent is weighed before said fluent material is introduced therein.

8. A process according to either of claims 1 or 3 in which said solidifying agent constitutes a plurality of materials.

9. A process according to either of claims 1 or 3 in which said solidifying agent is portland cement.

* * * * *